US007066850B1

(12) United States Patent
Carlsen et al.

(10) Patent No.: US 7,066,850 B1
(45) Date of Patent: Jun. 27, 2006

(54) METHOD OF SCORING A SPORTING EVENT

(76) Inventors: Linda Carlsen, 5428 Klemments La., Florence, MT (US) 59833; Dewaine Carlsen, 5428 Klemments La., Florence, MT (US) 59833

( * ) Notice: Subject to any disclaimer, the term of this patent is extended or adjusted under 35 U.S.C. 154(b) by 101 days.

(21) Appl. No.: 10/748,476

(22) Filed: Dec. 30, 2003

(51) Int. Cl.
*A63B 71/02* (2006.01)

(52) U.S. Cl. ..... 473/459; 273/445

(58) Field of Classification Search ..... 273/445, 273/459, 461, 336, 348, 359, 317; 119/702, 119/174

See application file for complete search history.

(56) References Cited

U.S. PATENT DOCUMENTS 4,842,275 A * 6/1989 Tsatskin ..... 473/468
6,837,497 B1 * 1/2005 Barnett ..... 273/445
2003/0173743 A1 * 9/2003 Brink et al. ..... 273/297
2004/0094897 A1 * 5/2004 Barnett ..... 273/445

* cited by examiner

*Primary Examiner*—Raleigh W. Chiu
(74) *Attorney, Agent, or Firm*—Jean Kyle

(57) ABSTRACT

A method for scoring a sporting event that offers all participants an opportunity to receive an award is described. A number of categories and a number of places to be awarded within those categories is determined. These numbers are multiplied and the sum is compared to the number of participants in the event that are eligible to receive an award. If the sum is greater than or equal to the number of eligible participants. Eligible participants are divided into categories and each place within those categories is given an award. The method eliminates the need for handicaps or classes and offers an objective method of scoring.

4 Claims, 1 Drawing Sheet

METHOD OF SCORING A SPORTING EVENT

BACKGROUND OF THE INVENTION

To allow players of various abilities to participate in a single event, handicaps or classifications are often incorporated into the event scoring system. The use of handicaps or classes however presents the opportunity to introduce bias and subjectivity into the scoring system. A scoring system that allows all to participate in a sporting event, while maintaining objectivity and fairness in scoring that event, would enhance participation and enjoyment of any event.

SUMMARY OF THE INVENTION

The method of the subject invention provides a means to score a sporting event that is objective and unbiased. The method involves determining a number of categories and the number of places to be awarded within those categories based on the total number of participants. The number of places to be awarded is multiplied by the number of categories to determine the number of participants that will be awarded. After the sporting event is complete, the number of participants eligible to be awarded is determined. If the number of eligible participants equals or exceeds the number of participants that will be awarded, the eligible participants are divided into categories and places are awarded within each category.

DETAILED DESCRIPTION OF THE INVENTION

Figure 1:
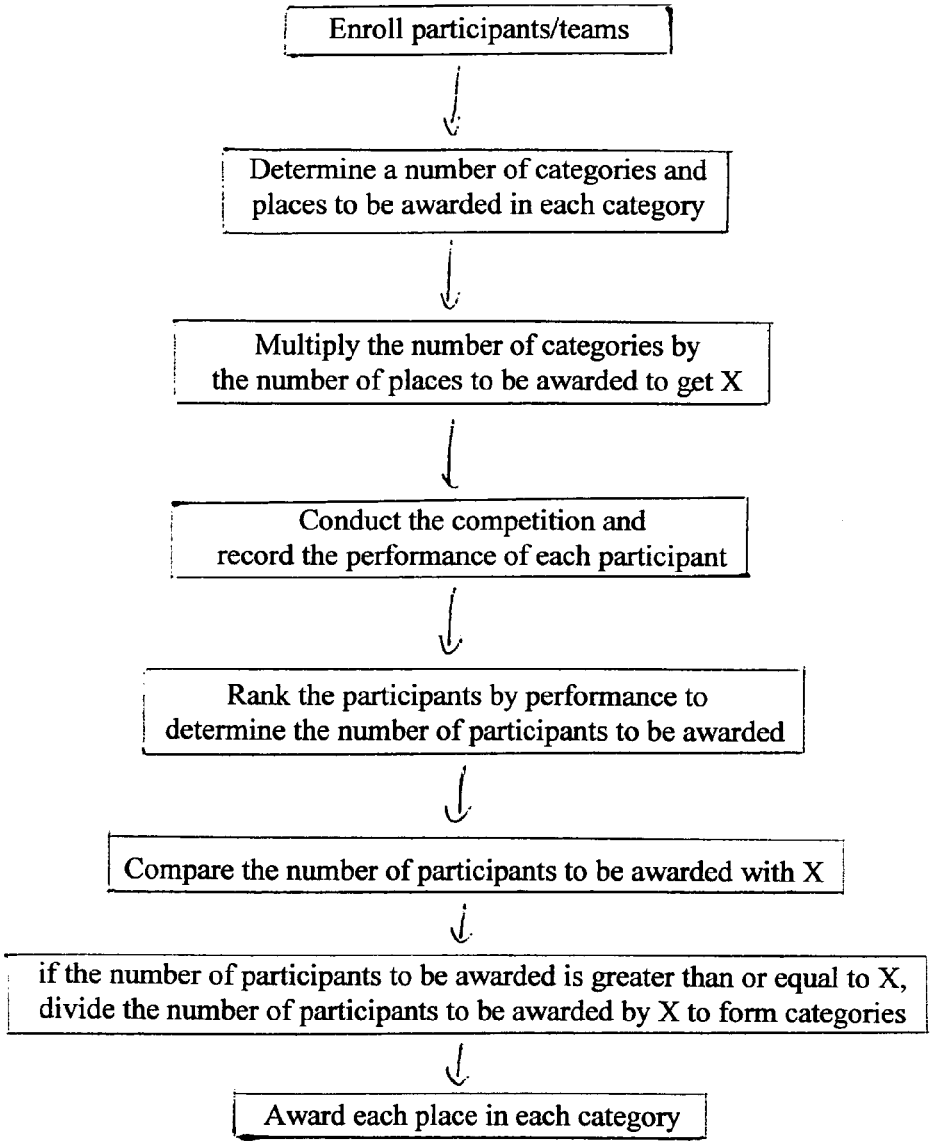
FIG. 1 is a flow diagram that illustrate a preferred embodiment of the method of the subject invention.

The method of the subject invention provides a system for scoring a sporting event that is fair and unbiased. The method encourages participation by all offering each participant an opportunity to receive an award no matter their skill level.

The method involves determining a number of categories and a number of places to be awarded in those categories. The number of categories is multiplied by the number of places to be awarded to get the number of participants that will be awarded. The number of participants eligible to be awarded is compared with the number of participants that will be awarded. If the number of eligible participants meets or exceeds the number of participants to be awarded, eligible participants are divided into categories and places are awarded within each category.

The number of categories and the places to be awarded within those categories is determined by the nature of the event. This number can be determined by the total number of participants in the event. If monetary awards are offered, entry fees, event costs and profit margin can be used in determining category number and places.

For example, the subject method is useful in scoring team roping events. In a team roping event, ropers participate in two person teams. Cash awards are given in team roping events. Each team pays an entry fee. From this fee, ⅓ is paid to the company that provides the stock for the event. Organizers of the event withhold part of the fee to pay facilities costs, insurance, and reserve some of the fee for profit. The remainder of the fee is applied toward a pool for cash awards. The following categories and places are appropriate for a team roping event:

| Number of Teams Participating in the Event | Number of Categories | Places to be Awarded in each Category |
|---|---|---|
| 25–50 teams | 2 categories | 1 place |
| 51–75 teams | 3 categories | 1 place |
| 76–100 teams | 4 categories | 1 place |
| 101–125 teams | 5 categories | 1 place |
| 126–200 teams | 5 categories | 2 places |
| 201–300 teams | 6 categories | 2 places |
| 301–400 teams | 7 categories | 2 places |
| 401–500 teams | 8 categories | 2 places |

In an event in which 400 teams participate, there would be seven categories and two places to be awarded within each category. The number of categories is multiplied by the places to be awarded in each category to determine the number of teams that will be paid.

| Number of Teams Participating | Number of Teams to be Paid |
|---|---|
| 25–50 teams | 2 teams |
| 51–75 teams | 3 teams |
| 76–100 teams | 4 teams |
| 101–125 teams | 5 teams |
| 126–200 teams | 10 teams |
| 201–300 teams | 12 teams |
| 301–400 teams | 14 teams |
| 401–500 teams | 16 teams |

Therefore, at a roping event in which 400 teams are participating, teams will know that as many as 14 teams will be paid cash awards.

Participants in a team roping event must rope all their steers to be eligible for a prize. Further, the ropings are timed. In the next step, the number of teams that are eligible to be paid are compared to the number of teams that will be paid. In the exemplified embodiment, where 400 teams participate in a roping event, about 35 teams rope all their steers (e.g. 5 of 5) and are eligible for a prize. That number is compared to the number of teams to be paid, 14. If the number of eligible teams equals or exceeds the number of teams to be paid, the teams are divided into categories. Therefore, since 35 exceeds 14, the 35 teams are divided into seven categories. The first and second place timed teams in each category are awarded a prize. If the number of teams eligible for a prize does not equal or exceed the number of teams to be awarded, the system can be altered so that near eligible teams or participants will also win a prize. For example, if, of the 400 participating teams, only 12 teams rope all their steers, teams roping 4 of 5 steers could be listed by time after the 12 teams. The 12 eligible teams are paid and then the fastest two teams roping 4 of 5 steers are paid so that a total of 14 teams are paid.

Specifically, a team roping event with 400 teams participating would operate as follows: $20 of each team's entry fee is applied to a prize pool making the available pool $8,000; eligible teams are divided into seven categories; the $8,000 is also divided by seven; first place teams in each category earn $686 and the second place teams in each category earn $457.

Currently, team roping events use a classification system where teams are classified by skill level. The classifications are based on proficiency in certain skills. Determining the level of proficiency can become a subjective process. The subject method eliminates subjective classification and provides professional ropers as well and beginners the opportunity to win prizes. The fastest and best roping teams will always win a prize. The subject method however offers ropers of every skill level a chance to win a prize. The subject method therefore offers all ropers an opportunity to compete and win.

The subject method has been described for use specifically in a team roping event. It is important to note however that the subject method can be applied to many types of events. The method can be used to score events judged only on time. Likewise, the subject method can be used to score events that involve the completion of a task. For example, the subject method would allow golfers of various skill levels to participate in a single tournament. All golfers participating, no matter the skill level would have an opportunity to win a prize. Further, in an event were almost all participants are eligible for a prize, it would be apparent, that the category number and place numbers could be varied to fit the field of players. The method of the subject invention eliminates subjectivity from scoring sporting events and allows all who participate the opportunity to compete for a prize.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A method of conducting a competition comprising the steps of:

a) enrolling participants for the competition;

b) determining a number of at least two categories;

c) determining a number of places to be awarded in said number of at least two categories;

d) multiplying said number of said categories by said number of places to be awarded;

e) conducting the competition and recording the performance of each participant in the competition;

f) ranking the participants by their performance in the competition and determining a number of participants eligible to be awarded;

g) comparing d) with the number of participants eligible to be awarded and if said number of eligible participants is greater than or equal to d);

h) dividing eligible participants by said number of at least two categories to divide said eligible participants into categories; and i) awarding a participant for each of said number of places to be awarded in each of said categories.

2. The method of claim 1, wherein b) and c) are determined based on a total number of participants in said competition.

3. The method of claim 2, wherein said number of participants eligible to be awarded does not equal said total number of participants.

4. A method of conducting a team roping event, the method comprising the steps of:

a) enrolling a total number of participating teams;

b) determining a number of at least two categories and a number of places to be awarded in said number of at least two categories using the following;

| Number of Teams Participating in the Event | Number of Categories | Places to be Awarded in each Category |
|---|---|---|
| 25–50 teams | 2 categories | 1 place |
| 51–75 teams | 3 categories | 1 place |
| 76–100 teams | 4 categories | 1 place |
| 101–125 teams | 5 categories | 1 place |
| 126–200 teams | 5 categories | 2 places |
| 201–300 teams | 6 categories | 2 places |
| 301–400 teams | 7 categories | 2 places |
| 401–500 teams | 8 categories | 2 places |

c) multiplying said number of said categories by said number of places to be awarded;

d) timing participating teams as each team attempts to rope at least one steer;

e) ranking the participating teams by time and determining a number of teams eligible to be awarded;

f) comparing c) with a number of teams eligible to be awarded and if said number of eligible teams is greater than or equal to c);

g) dividing eligible teams by said number of at least two categories to divide said eligible teams into categories; and h) awarding a participant for each of said number of places to be awarded in each of said categories.

* * * * *